US005989055A

United States Patent [19]

Cowan et al.

[11] Patent Number: 5,989,055

[45] Date of Patent: Nov. 23, 1999

[54] MECHANICALLY SEALED INSULATION DISPLACEMENT CONNECTOR

[75] Inventors: Douglas L. Cowan, Snellville, Ga.; David S. Kerr, Morris Plains, N.J.; Ivan Pawlenko, Holland, Pa.; Anthony R. Tancreto, Brooklyn, N.Y.

[73] Assignee: Lucent Technologies Inc., Murray Hill, N.J.

[21] Appl. No.: 09/106,864

[22] Filed: Jun. 30, 1998

[51] Int. Cl.[6] ..... H01R 4/24

[52] U.S. Cl. ..... 439/409

[58] Field of Search ..... 439/409, 410, 439/417

[56] References Cited

U.S. PATENT DOCUMENTS

| | | | |
|---|---|---|---|
| 4,341,430 | 7/1982 | Crawford | 439/409 |
| 5,102,347 | 4/1992 | Cote et al. | 439/412 |
| 5,435,747 | 7/1995 | Franckx et al. | 439/409 |
| 5,574,257 | 11/1996 | Brauer et al. | 174/76 |
| 5,685,733 | 11/1997 | Janczak | 439/395 |

*Primary Examiner*—Neil Abrams
*Assistant Examiner*—Javaid Nasri
*Attorney, Agent, or Firm*—Dickstein Shapiro Morin & Oshinsky LLP

[57] ABSTRACT

A mechanically sealed insulation displacement connector includes a contact and a wire holder. The wire holder has a channel for receiving an insulated wire and a slot for receiving the contact. One end of the channel has a conical shaped region which provides a positive stop for an inserted wire. The positive stop causes the insulation of the inserted wire to press against the inside surface of the conical region when the wire is inserted into the channel. The insulation is slightly deformed providing an inexpensive and effective seal for the wire's conductor without the use of gelled oils and greases. As the insulation is pressed against the conical shaped region, the wire holder is rotated enabling the contact to move into the slot where it pierces the insulation and grips the conductor of the wire, thereby making an electrical connection and holding the insulation against the conical shaped region.

39 Claims, 3 Drawing Sheets

MECHANICALLY SEALED INSULATION DISPLACEMENT CONNECTOR

FIELD OF THE INVENTION

This invention relates generally to electrical connectors, and specifically, to a mechanically sealed insulation displacement electrical connector assembly.

BACKGROUND OF THE INVENTION

Electrical connectors have become widely accepted as a preferred mechanism for interconnecting the circuitry components of electrically operated products and equipment. In these applications, providing for the easy connection and disconnection of wires through the use of connectors allows convenient assembly and maintenance as well as versatility of design.

Although the construction of today's connectors may vary, one type of connector known as an insulation displacement connector is generally preferred for interconnecting wires having conductors surrounded by an insulating layer. Generally, an insulation displacement connector includes a slotted conductive contact which receives an insulated wire. The contact severs the insulation covering as it receives the wire and establishes an electrical connection with the conductor of the wire. Therefore, an electrical connection can be achieved without stripping away the insulation from the wire or crimping a contact to a bare wire.

Insulation displacement connectors are used in a wide variety of applications, such as telecommunication applications, wherein the wire within the connector must be sealed from the environment or the surroundings within which the connector is used. Some connectors, particularly in telecommunication applications, for example, must be waterproof in order to seal off and protect the exposed wire within the connector from moisture. It is also important to seal out dirt, plant life and other potential corrosion deposits from the wires. Most of the connectors used in these devices include covers to partially protect the contact and wire from these harmful elements.

A network interface device is one application where insulation displacement connectors are commonly used. A network interface device serves as a junction for numerous electrical connections and can be used to provide limited access to the wiring of a telecommunications device. Network interface devices generally reside outside and are exposed to harmful environmental conditions, but are expected to maintain their electrical and mechanical characteristics for a service life of approximately 10 to 30 years. The connectors within the network interface device must be kept free from moisture. Moisture can cause corrosion resulting in a malfunctioning electrical circuit and service interruption.

It is well known to use grease or gelled oils to seal exposed wires within insulation displacement connectors. For example, U.S. Pat. No. 5,574,257 (Brauer et al.) refers to a gelled oil composition used to protect the wires within terminal blocks. U.S. Pat. No. 5,102,347 (Cote et al.) refers to an insulation displacement terminal for a telecommunication device also using a gelled oil sealant. The problem with gelled oils and grease is that they add expense and additional steps in the assembly process of the device utilizing the insulation displacement connector.

In addition, most network interface devices require that the wires within the insulation displacement connectors be easily removable for maintenance and replacement purposes. Removing and reinstalling wires coated with grease and gelled oils can lead to unreliable seals since many gels and greases do not restore to their original consistency after the first use. Subsequent installations or connections may be interfered with by a build up of the existing grease or gelled oils. Therefore, there is a need to provide an insulation displacement connector providing sealing means for the wire within the connector that is both inexpensive, reusable and reliable under removal and reinstallation conditions.

SUMMARY OF THE INVENTION

This invention provides an insulation displacement connector having an inexpensive sealing mechanism which protects the wire within the connector from moisture and other harmful elements which may be present in environmental surroundings.

This invention also provides an insulation displacement connector having a sealing mechanism which protects the wire within the connector from moisture and other harmful elements and which is reliable under removal and reinstallation conditions.

The invention provides a mechanically sealed insulation displacement connector. The mechanically sealed insulation displacement connector includes a contact and a wire holder. The wire holder has a channel for receiving an insulated wire and a slot for receiving the contact. One end of the channel has a conical shaped region which provides a positive stop for an inserted wire. The positive stop causes the insulation of the inserted wire to press against the inside surface of the conical region when the wire is inserted into the channel. The insulation is slightly deformed providing an inexpensive and effective seal for the wire's conductor without the use of gelled oils and greases. As the insulation is pressed against the conical shaped region, the wire holder is rotated enabling the contact to move into the slot where it pierces the insulation and grips the conductor of the wire, thereby making an electrical connection and holding the insulation against the conical shaped region. Moreover, removal and reinstallation of the wire can be reliably performed without adverse consequences to the new connection or seal.

BRIEF DESCRIPTION OF THE DRAWINGS

The foregoing and other advantages and features of the invention will become more apparent from the detailed description of the preferred embodiments of the invention given below with reference to the accompanying drawings in which.

DETAILED DESCRIPTION OF THE PREFERRED EMBODIMENTS

Figure 1:
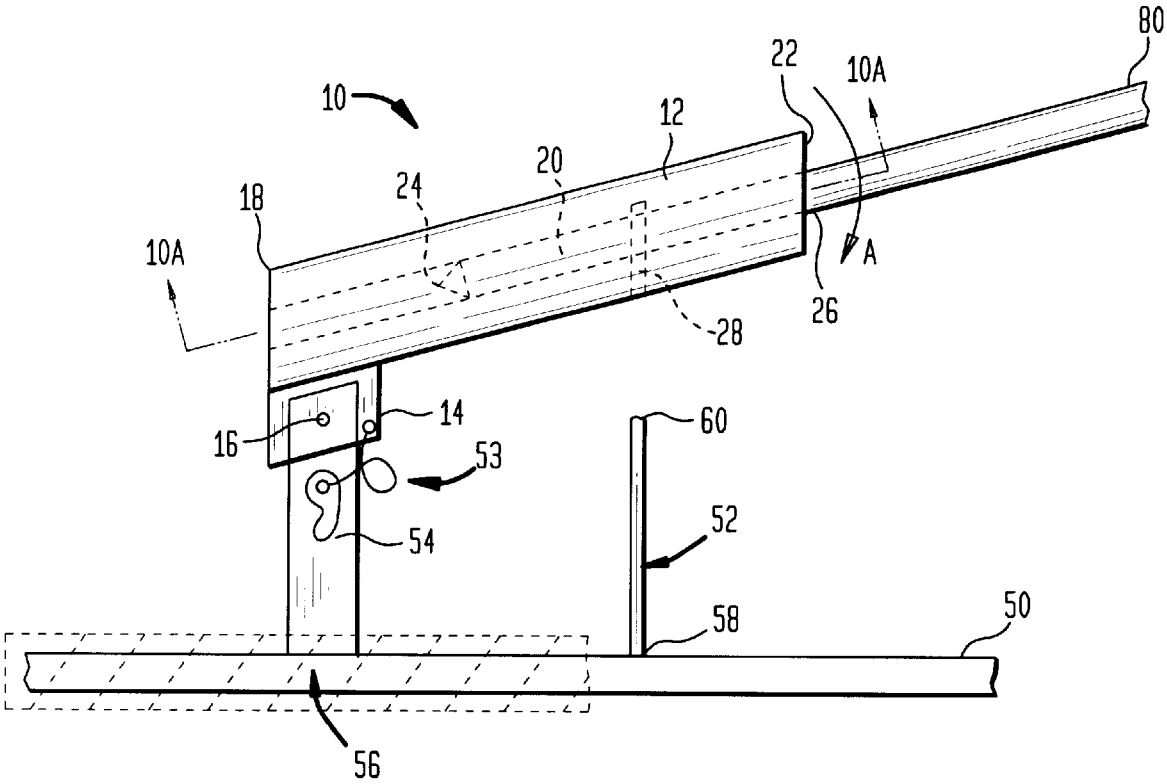
FIG. 1 is a view of an insulation displacement connector constructed in accordance with the present invention.

FIG. 1 illustrates a mechanically sealed insulation displacement connector 10 constructed in accordance with the present invention. As shown in FIG. 1, the connector 10 includes a wire holder 12, a base 50 and an insulation displacement contact 52. The wire holder 12 is preferably made of hard plastic, although any rigid non-conductive material may be used. In a preferred embodiment, the wire holder 12 acts as a cover for the connector as will be described below. The base 50 is a printed circuit board containing an electrical circuit or connections. The printed circuit board may also be mounted upon another substrate (not shown) for additional support or protection if desired. In addition, base 50 may be formed of a printed circuit board residing in between two layers of supporting substrate, shown by dotted lines in FIG. 1.

Figure 2:
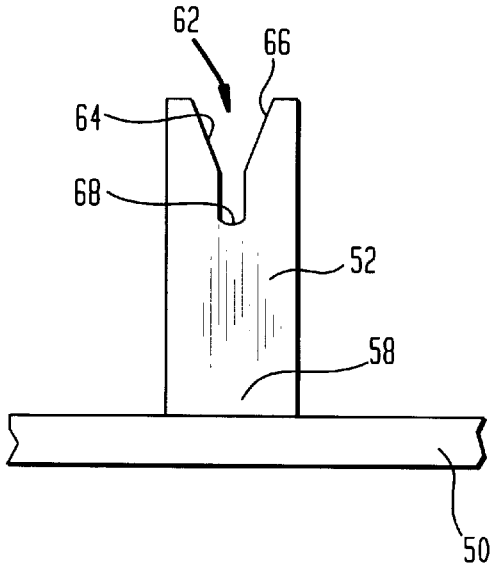
FIG. 2 is a front view of a contact used in the insulation displacement connector of FIG. 1.

The contact 52 is a conductive contact electrically connected to and extending from the printed circuit board of the base 50 at a first end 58. Referring now to FIG. 2, it can be seen that the contact 52 is a plate-like contact having a notch 62 formed in a second end 60. The notch 62 has angled edges 64, 66 used to pierce only the insulation of a wire 80 (FIG. 1) and a curved wire receiving region 68 used to form an electrical connection with the conductive portion (the central core) of the wire 80. The contact 52 is constructed of a resilient conductive material. Plate-like contacts, such as the contact 52 illustrated in FIG. 2, are well known in the art and are described in U.S. Pat. No. 5,685,733 (Janczak) which is hereby incorporated by reference in its entirety.

Referring now to FIG. 1, a first end 18 of the wire holder 12 has an extending pivot portion 14. A first end 56 of the base 50 has a shaft portion 54 that is pivotally engageable with the pivot portion 14 of the wire holder 12. The wire holder 12 is pivotally mounted to the base 50 by inserting the shaft portion 54 of the base 50 in to the pivot portion 14 of the wire holder 12. A pivot pin 16 is used to maintain the engagement of the pivot portion 14 to the shaft portion 54. This construction allows the wire holder 12 to act as a cover for the connector 10 and to be moved in the direction shown by arrow "A". Although the wire holder 12 has been described as being mounted to the base 50, the invention is not to be so limited. Any wire holder 12 constructed as described in detail below will be suitable to practice the present invention whether or not it is mounted to the base 50.

Figure 3:
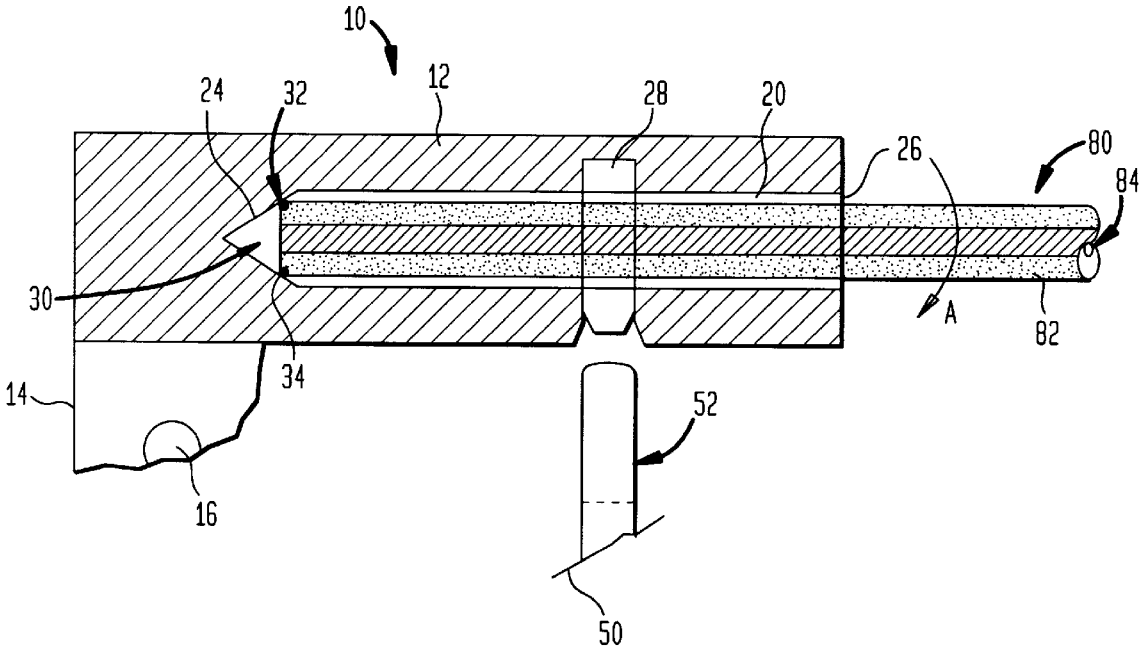
FIG. 3 is a cross sectional view along line 10*a*–10*a* of FIG. 1.

The wire holder 12 contains a channel 20 capable of receiving an insulated wire 80. The channel 20 has two ends 24, 26. The diameter of the channel 20 can vary and is dependent upon the diameter of the wire 80 to be inserted in to the channel 20. FIG. 3 illustrates a cross sectional view along line 10*a*–10*a* of the connector 10 of FIG. 1. A conical shaped region 30 is formed in the first end 24 of the channel 20. An insulated wire 80 containing an insulation layer 82 surrounding an electrical conductor 84 is inserted in to the second end 26 of the channel 20 until it abuts against the internal surface of the conical shaped region 30 of the first end 24. The diameter of the channel 20 is just slightly larger than the external diameter of the wire 80 so that wire 80 can be snugly inserted into the channel 20. The circumferential pressing of the insulation layer 82 against the conical shaped region 30 is shown in the FIG. 3 cross-sectional view as points 32, 34. The insertion force for wire 80 causes the insulation layer 82 to become slightly deformed. The deformation of the insulation layer 82 effectively seals the electrical conductor 84 of the wire 80 from hazardous environmental elements such as moisture or dirt. Therefore, the conical shaped region 30 forms an annular seal when an insulated wire 80 is pressed against it defining a sealing region of the channel 20.

As shown in FIG. 3, the wire holder 12 also has a slot 28 which intersects the channel 20 between the two ends 24, 26. The slot 28 is positioned within the wire holder 12 and is of sufficient size to permit the insulation displacement contact 52 to be inserted therein when the holder 12 is moved in the direction of arrow "A". The channel 20 begins at a second end 22 of the wire holder 12 and runs approximately two thirds of the length of the holder 12. It must be noted that the length of the channel 20 is not critical. The channel 20 may run the entire length of the wire holder 12, or it may run less than a third of the length of the holder 12, as long as an insulated wire 80 can be inserted in to the channel 20 and the slot 28 can engage the contact 52 when the holder 12 is moved in direction A. Additionally, the channel 20 may begin at the first end 18 of the wire holder 12.

With reference to FIGS. 1–3, a description of the operation of the mechanically sealed insulation displacement connector 10 now follows. An insulated wire 80 containing an insulation layer 82 surrounding an electrical conductor 84 is snugly inserted in to the second end 26 of the channel 20 until it is pressed against the internal surface of the conical shaped region 30 of the first end 24 at points 32, 34. The insulation layer 82 becomes slightly deformed by being pressed against the circumference of the conical shaped region 30, e.g., at points 32, 34 in the cross-section shown in FIG. 3. The deformation of the insulation layer 82 forms a seal protecting the electrical conductor 84 from hazardous environmental elements such as moisture or dirt. Once the wire 80 has been inserted in to the channel 20 and it held such that it presses against the conical shaped region 30, the wire holder 12 is moved in the direction of arrow "A" allowing the angled edges 64, 66 of the contact 52 to pierce the insulation layer 82 until the curved wire receiving region 68 comes into contact with the conductor 84 forming an electrical connection.

Figure 5:
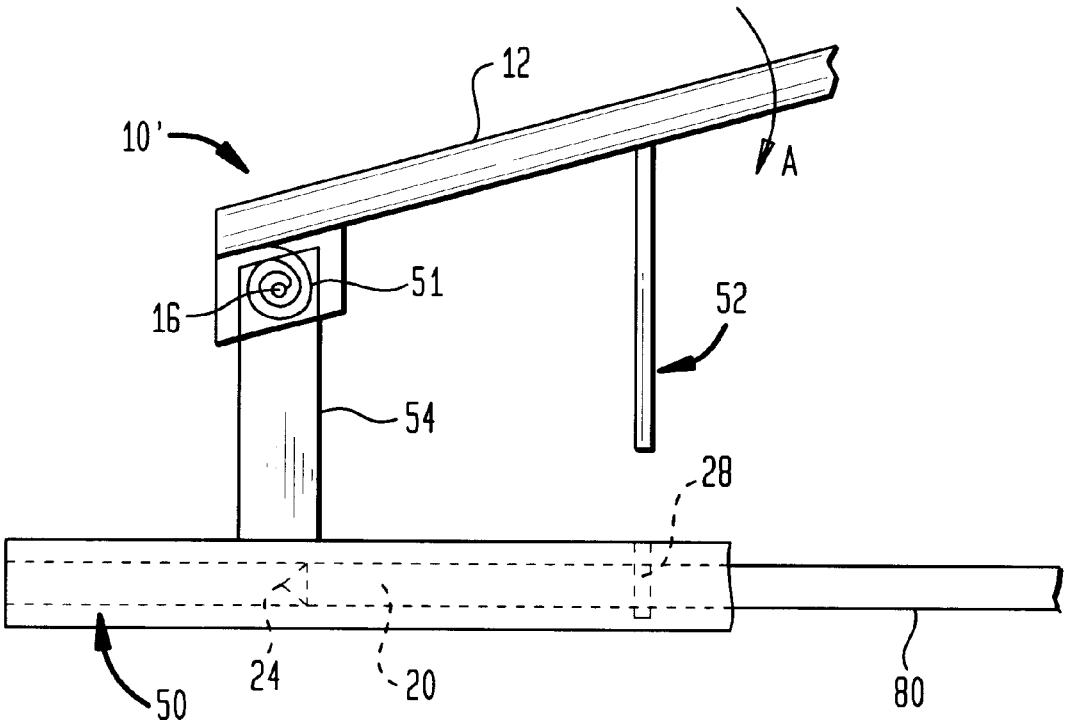
FIG. 5 is a view of an insulation displacement connector constructed in accordance with the present invention.

The contact 52 keeps the wire 80 and the wire holder 12 in place while maintaining the electrical connection and the seal at conical shaped region 30 until the holder 12 is moved in the direction opposite to that shown by arrow "A" in FIGS. 1 and 3 therby removing the contact 52 from slot 28. To further facilitate use of the connector 10, the wire holder 12 may be lightly biased by a spring 51 (see FIG. 5) around shaft portion 54 to the position shown in FIG. 1. Displacement of wire holder 12 in the direction of arrow "A" would then be against the spring's force. Alternatively, a toggle spring mechanism 53 could be used so that wire holder 12 can move between two stable states, one being shown in FIG. 1 and the other being the position where contact 52 is engaged with the wire 80.

The mechanically sealed insulation displacement connector 10 seals the conductor 84 of the wire 80 without the use of gelled oils or grease. In doing so, the connector 10 allows maintenance personnel to open the connector 10 by lifting wire holder 12 in a direction opposite to that shown by arrow "A", and remove and reinstall the wire 80 in a reliable fashion. That is, the reinserted wire 80 will continue to form a proper electrical connection with the contact 52, as described above, and remain properly sealed without the use of a grease or gelled oil. In addition, the connector 10 remains more durable than prior art connectors since grease and gelled oils have a tendency to break down over time effecting the quality of the seal. In addition, by not using grease or gelled oils to seal the wire 80, the assembly of the connector 10 is inexpensive and easier since the channel 20 is molded in to the wire holder 12 as the holder 12 is being manufactured.

Figure 4:
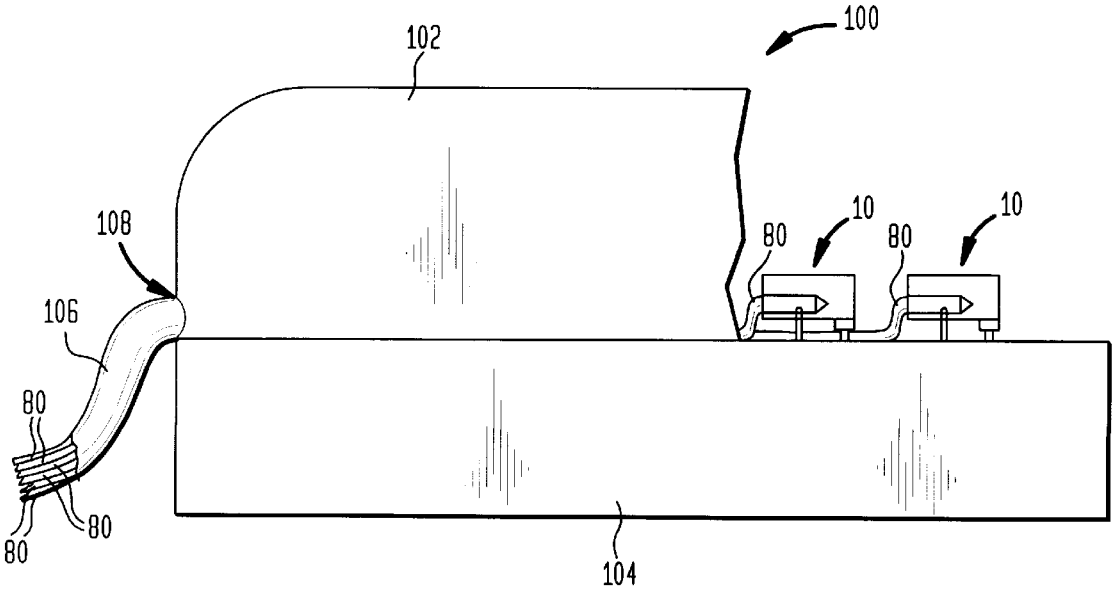
FIG. 4 is a perspective view of a network interface device utilizing an insulation displacement connector constructed in accordance with the present invention.

FIG. 4 illustrates one example of network interface device 100 utilizing the mechanically sealed insulation displacement connector 10 of the present invention. The device 100 includes an access cover 102, a base 104, a plurality of wires 80 enclosed in a casing 106, and a plurality of connectors 10.

The access cover 102 is placed over the base 104, is removable and contains a hole 108 where the casing 106 is inserted in to the device 100. The base 104 contains the circuitry (not shown) to be connected to the wires 80 and connectors 10 for each wire 80. The connector 10 is constructed and operated as described above with respect to FIGS. 1–3. It must be noted that the network interface device 100 illustrated in FIG. 4 is only but one example of the use of the invention. For example, the device 100 could include numerous holes 108 for the individual wires 80 or an access cover 102 that has doors or panels. In addition, the device 100 does not have to be a network interface device. The device 100 can be any circuitry or device requiring the interconnection of wires by insulation displacement.

It must be noted that the mechanically sealed insulation displacement connectors 10 of the present invention could also be used as a replacement for already existing connectors. That is, the connector 10 can be included in a maintenance or parts kit whereby maintenance personnel can remove a connector 10 from the kit and replace an existing connector on a device. In addition, it must also be noted that the connector 10 can also be constructed such that the channel 20 is formed within the base 50 and the contact 52 resides on the wire holder 12; in this configuration of the connector 10, the wire holder 12 and the contact 52 would be moved such that the contact 52 enters the slot 28 of the channel formed in the base 50 (see FIG. 5). It is also possible for the base 50 to have a pivot portion pivotally mounted on a shaft of the holder 12.

While the invention has been described in detail in connection with preferred embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Accordingly, the invention is not to be seen as limited by the foregoing description, but is only limited by the scope of the appended claims.

What is claimed as new and desired to be protected by Letters Patent of the United States is:

1. An electrical connector comprising:

a wire holder, said wire holder having a channel formed therein capable of receiving an insulated wire, said channel having a first end and a second end, said channel first end having a sealing region for engaging with the insulation of said wire when said wire is inserted into said channel, said channel second end being open to receive an inserted insulated wire, said wire holder having a slot intersecting said channel between said channel first and second ends;

a stationary support for supporting said wire holder;

a pivot element connecting said stationary support to said wire holder such that said wire holder is rotatable about said pivot element; and an electrical contact for entering said slot and engaging with a wire inserted in said channel upon rotation of said wire holder in a first direction about said pivot element.

2. The electrical connector according to claim 1 wherein said sealing region has a conical shape and forms an annular seal when an inserted wire is pressed against said sealing region.

3. The electrical connector according to claim 1 further comprising a base, wherein said electrical contact is electrically connected to and extends from said base.

4. The electrical connector according to claim 3 wherein the base is a printed circuit board.

5. The electrical connector according to claim 3 wherein said contact is an insulation displacement contact.

6. The electrical connector according to claim 3 further comprising a biasing means for maintaining said wire holder in a position where the contact is not moved into said slot.

7. The electrical connector according to claim 3 further comprising a toggle mechanism connected to said stationary support for maintaining said wire holder in a stable position.

8. A mechanically sealed insulation displacement connector comprising:

a holder;

an insulation displacement contact electrically connected to an extending from said holder; and a base, said base having a channel formed therein capable of receiving an insulated wire, said channel having a first end and a second end, said channel first end having a conical shaped sealing region for engaging with the insulation of said wire when said wire is inserted into said channel, said channel second end being open to receive an inserted insulated wire, said base having a slot intersecting said channel between said channel first and second ends, said slot capable of receiving said contact.

9. The mechanically sealed insulation displacement connector according to claim 8 wherein said sealing region forms an annular seal when an insulated wire is pressed against said sealing region and the insulation of the wire deforms.

10. The mechanically sealed insulation displacement connector according to claim 8 wherein the base is a printed circuit board.

11. The mechanically sealed insulation displacement connector according to claim 8 wherein said base has a shaft portion extending therefrom, said holder has a pivot portion extending therefrom, said pivot portion is pivotally mounted to said shaft portion, and said slot is in alignment with said contact during pivotal movement of said holder to enable said contact to move into said slot.

12. The electrical connector according to claim 11 further comprising a biasing means for maintaining said wire holder in an position where the contact is not moved into said slot.

13. The electrical connector according to claim 11 further comprising a toggle mechanism connected to said shaft portion for maintaining said wire holder in a stable position.

14. A connector device comprising:

a first base;

a plurality of electrical connectors mounted on said first base, each of said electrical connectors comprising:

a second base, having a shaft portion extending therefrom;

a contact electrically connected to and extending from said second base; and a wire holder, said wire holder having a channel formed therein capable of receiving an insulated wire, said channel having a first end and a second end, said channel first end having a sealing region for engaging with the insulation of said wire when said wire is inserted into said channel, said channel second end being open to receive an inserted insulated wire, said wire holder having a slot intersecting said channel between said channel first and second ends, said slot being capable of receiving said contact, said holder having a pivot portion extending therefrom, said pivot portion is pivotally mounted to said shaft portion of said second base, said slot being in alignment with said contact during pivotal movement of said holder to enable said contact to move into said slot, wherein said inserted wire and said channel are approximately perpendicular to said shaft portion when said contact is moved into said slot and engages said inserted wire.

15. The connector device according to claim 14 wherein said sealing region has a conical shape and forms an annular seal when an insulated wire is pressed against said sealing region.

16. The connector device according to claim 14 wherein the second base is a printed circuit board.

17. The connector device according to claim 14 wherein said contact is an insulation displacement contact.

18. The connector device according to claim 14 further comprising an access cover mounted on said first base, said access cover covering said plurality of electrical connectors.

19. A connector device comprising:

a first base;

a plurality of electrical connectors mounted on said first base, each of said electrical connectors comprising:

a wire holder, said wire holder having a channel formed therein capable of receiving an insulated wire, said channel having a first end and a second end, said channel first end having a sealing region for engaging with the insulation of said wire when said wire is inserted into said channel, said channel second end being open to receive an inserted insulated wire, said wire holder having a slot intersecting said channel between said channel first and second ends;

a stationary support for supporting said wire holder;

a pivot element connecting said stationary support to said wire holder such that said wire holder is rotatable about said pivot element; and an electrical contact for entering said slot and engaging with a wire inserted in said channel upon rotation of said wire holder in a first direction about said pivot element.

20. The connector device according to claim 19 wherein said sealing region has a conical shape and forms an annular seal when an insulated wire is pressed against said sealing region.

21. The connector device according to claim 19 wherein said contact is an insulation displacement contact.

22. The connector device according to claim 19 further comprising a second base, wherein said electrical contact is connected to and extending from said second base.

23. The connector device according to claim 22 wherein the second base is a printed circuit board.

24. The connector device according to claim 22 further comprising an access cover mounted on said first base, said access cover covering said plurality of electrical connectors.

25. A method of producing a mechanically sealed insulation displacement connector comprising:

providing a holder for an insulated electrical wire;

forming a channel capable of receiving the insulated electrical wire within said holder, said channel including a sealing region for sealing a wire inserted into said sealing region from environmental elements;

forming a slot intersecting said channel, said slot being capable of receiving an electrical contact;

providing a stationary support for supporting said holder; and providing a pivot element connecting said stationary support to said holder such that said holder is rotatable about said pivot element, wherein a received electrical contact enters said slot upon rotation of said holder in a first direction about said pivot element.

26. The method according to claim 25 further comprising the step of providing a conical shaped sealing region at an end of said channel as said sealing region.

27. The method according to claim 25 further comprising the steps of:

providing said electrical contact;

providing a base for holding said electrical contact; and connecting said electrical contact to said base.

28. The method according to claim 27 wherein said electrical contact is an insulation displacement contact.

29. The method according to claim 27 wherein said base is a printed circuit board.

30. A method of producing a mechanically sealed insulation displacement connector comprising:

providing a base for an insulated electrical wire;

forming a channel capable of receiving the insulated electrical wire within said base;

providing a conical shaped region at the end of said channel as a sealing region for sealing a wire inserted into said sealing region from environmental elements;

forming a slot intersecting said channel, said slot being capable of receiving an electrical contact;

providing said electrical contact;

providing a holder for said electrical contact; and connecting said electrical contact to said holder.

31. The method according to claim 30 wherein said electrical contact is an insulation displacement contact.

32. The method according to claim 30 wherein said base is a printed circuit board.

33. The method according to claim 30 further comprising the steps of:

forming a pivot portion on an end of said holder;

forming a shaft portion on an end of said base; and pivotally mounting said holder pivot portion on said base shaft portion.

34. The method according to claim 30 further comprising the steps of:

forming a shaft portion on an end of said holder;

forming a pivot portion on an end of said base; and pivotally mounting said pivot portion on said shaft portion.

35. A method of sealing an insulated electrical wire using an insulation displacement connector, said connector comprising a holder, said holder having a channel formed therein capable of receiving an insulated wire, said channel having a first end and a second end, said channel first end having a conical shaped sealing region, said channel second end being open to receive an insulated wire, said holder having a slot intersecting said channel between said channel first and second ends, said method comprising the steps of:

inserting the wire in to said channel until the insulation of said wire presses against an inner surface of said conical shaped sealing region; and mounting said slot onto an electrical contact while said wire is pressed against said inner surface until the contact pierces the insulation of the wire and makes an electrical connection with a conductor of the wire.

36. A method of sealing an insulated electrical wire using an insulation displacement connector, said connector comprising a base and a holder, said holder having an electrical contact extending therefrom, said base having a channel formed therein capable of receiving an insulated wire, said channel having a first end and a second end, said channel first end having a conical shaped sealing region, said channel second end being open to receive an insulated wire, said base having a slot intersecting said channel between said channel first and second ends, said method comprising the steps of inserting the wire in to said channel until the insulation of said wire presses against an inner surface of said conical shaped sealing region and inserting said electrical contact into said slot while said wire is pressed against said inner surface until the contact pierces the insulation of the wire and makes an electrical connection with a conductor of the wire.

37. An electrical connector comprising:

a base having a shaft portion and an electrical contact extending therefrom; and a wire holder, said wire holder having a channel formed therein capable of receiving an insulated wire, said channel having a first end and a second end, said channel first end having a sealing region for engaging with the insulation of said wire when said wire is inserted into said channel, said channel second end being open to receive an inserted insulated wire, said wire holder having a slot intersecting said channel between said channel first and second ends, said holder having a pivot portion extending therefrom, said pivot portion is pivotally mounted to said shaft portion of said base, said slot being in alignment with said contact during pivotal movement of said holder to enable said contact to move into said slot, wherein said inserted wire and said channel are approximately perpendicular to said shaft portion when said contact is moved into said slot and engages said inserted wire.

38. An electrical connector comprising:

a wire holder having first and second ends, said wire holder having a channel formed therein capable of receiving an insulated wire, said channel having a first end and a second end, said channel first end having a sealing region for engaging with the insulation of said wire when said wire is inserted into said channel, said channel second end being open to receive an inserted insulated wire, said wire holder having a slot intersecting said channel between said channel first and second ends;

a stationary support for supporting said wire holder;

a pivot coupling connecting said stationary support to one end of said wire holder such that said wire holder and its associated channel are moveable about said pivot coupling; and an electrical contact for entering said slot and engaging with a wire inserted into said channel.

39. An electrical connector comprising:

a wire holder, said wire holder having a channel formed therein capable of receiving an insulated wire, said channel having a first end and a second end, said channel first end having a conical shaped sealing region for engaging with the insulation of said wire when said wire is inserted into said channel, said channel second end being open to receive an inserted insulated wire, said wire holder having a slot intersecting said channel between said channel first and second ends; and an electrical contact for entering said slot and engaging with a wire inserted in said channel.

* * * * *